US010317821B2

(12) United States Patent
Nakajima

(10) Patent No.: US 10,317,821 B2
(45) Date of Patent: Jun. 11, 2019

(54) INTERMEDIATE TRANSFER UNIT AND IMAGE FORMING APPARATUS

(71) Applicant: CANON KABUSHIKI KAISHA, Tokyo (JP)

(72) Inventor: Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/155,224

(22) Filed: Oct. 9, 2018

(65) Prior Publication Data

US 2019/0041774 A1 Feb. 7, 2019

Related U.S. Application Data

(63) Continuation of application No. PCT/JP2017/011113, filed on Mar. 21, 2017.

(30) Foreign Application Priority Data

Apr. 14, 2016 (JP) ..... 2016-080717

(51) Int. Cl.
*G03G 15/00* (2006.01)
*G03G 15/01* (2006.01)
*G03G 15/16* (2006.01)

(52) U.S. Cl.
CPC ..... *G03G 15/1615* (2013.01); *G03G 15/0189* (2013.01)

(58) Field of Classification Search
CPC ..... G03G 15/0189; G03G 15/1615
See application file for complete search history.

(56) References Cited

U.S. PATENT DOCUMENTS

| | | | | |
|---|---|---|---|---|
| 8,818,240 | B2 | 8/2014 | Murakami | |
| 9,091,965 | B2 | 7/2015 | Nakaegawa | |
| 9,195,175 | B2 | 11/2015 | Murakami | |
| 2013/0136498 | A1 | 5/2013 | Ju et al. | |
| 2016/0378025 | A1* | 12/2016 | Inuzuka | G03G 15/1615 399/299 |

FOREIGN PATENT DOCUMENTS

| | | | |
|---|---|---|---|
| JP | 2008-298835 | A | 12/2008 |
| JP | 2011-186106 | A | 9/2011 |
| JP | 2012-159571 | A | 8/2012 |
| JP | 2012-247756 | A | 12/2012 |
| JP | 2015-087714 | A | 5/2015 |

OTHER PUBLICATIONS

International Search Report dated Jun. 6, 2017, in International Application No. PCT/JP2017/011113.

* cited by examiner

*Primary Examiner* — David M. Gray
*Assistant Examiner* — Michael A Harrison
(74) *Attorney, Agent, or Firm* — Venable LLP

(57) ABSTRACT

An intermediate transfer unit, which is supported by an image forming apparatus, includes a moving mechanism which is capable of moving to an abutting position at which a first transfer member abuts against an intermediate transfer belt and a separating position at which the first transfer member is separated from the intermediate transfer belt; and a changing mechanism which changes a biasing force for abutting a second transfer member against the intermediate transfer belt. The biasing force is changed such that the biasing force when the first transfer member is at the separating position becomes weaker than the biasing force when the first transfer member is at the abutting position.

9 Claims, 7 Drawing Sheets

INTERMEDIATE TRANSFER UNIT AND IMAGE FORMING APPARATUS

CROSS-REFERENCE TO RELATED APPLICATIONS

This application is a Continuation of International Patent Application No. PCT/JP2017/011113, filed Mar. 21, 2017, which claims the benefit of Japanese Patent Application No. 2016-080717, filed Apr. 14, 2016, both of which are hereby incorporated by reference herein in their entirety.

FIELD OF THE INVENTION

The present invention relates to an intermediate transfer unit included in an image forming apparatus, and an image forming apparatus. Here, the image forming apparatus refers to, for example, an electrophotographic copying machine, an electrophotographic printer (for example, a laser beam printer, an LED printer, or the like), or the like.

BACKGROUND ART

Recently, along with an increase in the speed of image forming apparatuses, a configuration in which a plurality of image forming portions having developers of different colors are arranged side by side and the image forming processes of respective colors are processed in parallel is mainstream.

For example, in a full-color image forming apparatus in an electrophotographic type, there is an intermediate transfer tandem type in which toner images of the respective colors are sequentially overlapped and transferred onto a surface of an intermediate transfer belt by a primary transfer roller (transfer member), and after that, a full-color toner image is collectively transferred onto a recording material. This intermediate transfer tandem type has advantages that can cope with high productivity or conveyance of various media. The intermediate transfer belt is driven to travel in a state of being stretched by a plurality of stretching rollers including a driving roller.

In such an intermediate tandem type image forming apparatus, in order to reduce the abutting pressure of the primary transfer roller, a configuration in which the primary transfer roller is offset from a photosensitive member toward the downstream side in a conveyance direction of the intermediate transfer belt has been proposed (see Patent Literature 1).

In an intermediate transfer tandem type image forming apparatus, in the case of forming an image of a monochrome single color, a configuration in which a primary transfer roller included in a color image forming portion is separated from an intermediate transfer belt has been known.

Here, the tension of the intermediate transfer belt may change according to the change in the stretching layout of the intermediate transfer belt at the time of monochrome image formation and at the time of color image formation. In this case, if the primary transfer rollers are arranged as disclosed in Patent Literature 1, the force received by a black primary transfer roller which is not separated from the intermediate transfer belt may change and the following phenomenon may occur.

That is, along with the change from the stretching layout at the time of color image formation to the stretching layout at the time of monochrome image formation, when the tension of the intermediate transfer belt changes from a high state to a low state, the pressing force of the intermediate transfer belt to the primary transfer roller is weakened. The primary transfer roller 55 is applied with a biasing force by a primary transfer spring. Therefore, when the pressing force of the intermediate transfer belt 57 against the biasing force decreases, the primary transfer roller 55 changes from a position indicated by a solid line to a position indicated by a dashed line as illustrated in FIG. 7. In addition, as the position of the primary transfer roller 55 changes, a contact point P2 between the primary transfer roller 55 and the intermediate transfer belt 57 changes to a contact point P3. Therefore, a contact point distance from a contact point P1 between a photosensitive drum 51 and the intermediate transfer belt 57 to a contact point between the primary transfer roller 55 and the intermediate transfer belt 57 changes from L1 to L2. Along with the change of the contact point distance, a primary transfer current flowing from the primary transfer roller 55 to the photosensitive drum 51 changes when a bias is applied to the primary transfer roller 55, because the intermediate transfer belt 57 is a resistor. This may cause image defects.

Accordingly, the present invention has been made in view of such circumstances, and an object of the present invention is to provide an intermediate transfer unit capable of suppressing a change in a current flowing from a transfer member to a photosensitive member in a configuration in which a part of a plurality of transfer members can be separated from an intermediate transfer belt.

CITATION LIST

Patent Literature

Patent Literature 1: Japanese Patent Laid-Open No. 2012-247756

SUMMARY OF THE INVENTION

A representative configuration of an intermediate transfer unit according to the present invention to achieve the above object is an intermediate transfer unit, which is supported by an image forming apparatus, the intermediate transfer unit including: an endless intermediate transfer belt onto which developer images respectively formed on surfaces of first and second photosensitive members are transferred; first and second transfer members which are respectively disposed corresponding to the first and second photosensitive members and abut on an inner peripheral surface of the intermediate transfer belt to transfer the developer image onto the intermediate transfer belt, wherein a first position which is a downstream side end portion of a region in which the photosensitive member and the intermediate transfer belt abut at the time of the transfer in a moving direction of the intermediate transfer belt is disposed upstream of a second position which is an upstream side end portion of a region in which the intermediate transfer belt and the transfer member corresponding to the photosensitive member abut; a moving mechanism which is capable of moving to an abutting position at which the first transfer member abuts against the intermediate transfer belt and a separating position at which the first transfer member is separated from the intermediate transfer belt; and a changing mechanism which changes a biasing force for abutting the second transfer member against the intermediate transfer belt, wherein the biasing force is changed such that the biasing force when the first transfer member is at the separating position becomes weaker than the biasing force when the first transfer member is at the abutting position.

Further features of the present invention will become apparent from the following description of exemplary embodiments with reference to the attached drawings.

DESCRIPTION OF THE EMBODIMENTS

First Embodiment

<Image Forming Apparatus>

First, an overall configuration of an image forming apparatus A including an intermediate transfer unit according to a first embodiment of the present invention will be described with reference to the drawings together with an operation at the time of image formation.

The image forming apparatus A is an electrophotographic type or intermediate transfer tandem type color image forming apparatus which primarily transfers toners of four colors, that is, yellow Y, magenta M, cyan C, and black K, to an intermediate transfer belt, and then secondarily transfers the same onto an image forming medium to form an image.

Figure 1:
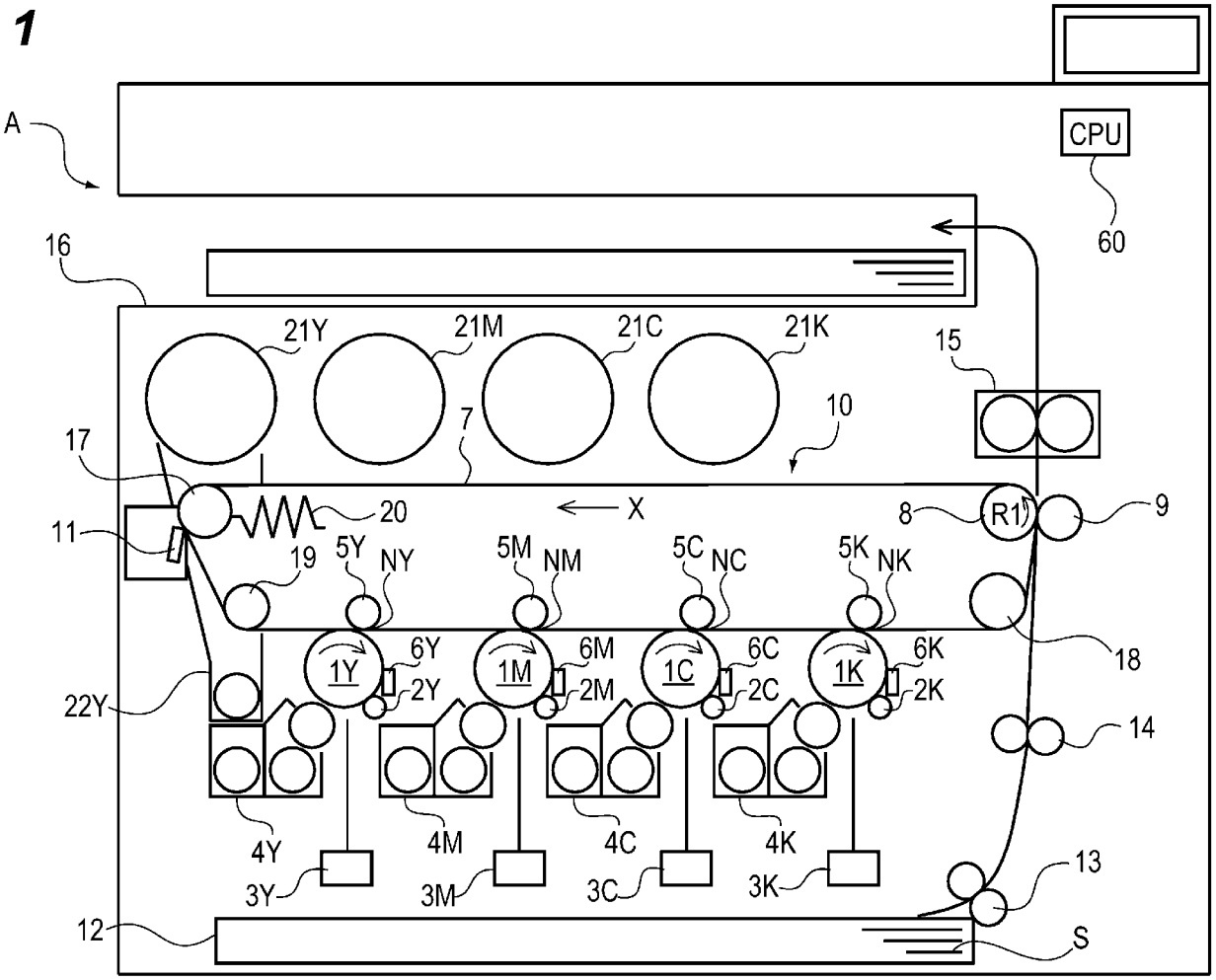
FIG. 1 is a schematic cross-sectional view of an image forming apparatus.

As illustrated in FIG. 1, the image forming apparatus A includes an image forming portion which transfers a toner image onto a sheet, a sheet feeding portion which feeds the sheet to the image forming portion, and a fixing portion which fixes the toner image onto the sheet.

As illustrated in FIG. 1, the image forming portion includes a plurality of photosensitive drums 1 (1Y, 1M, 1C, 1K) serving as photosensitive members rotatably provided, and charging members 2 (2Y, 2M, 2C, 2K) which charge the photosensitive drums 1. In addition, the image forming apparatus A includes an intermediate transfer unit 10, laser scanner units 3 (3Y, 3M, 3C, 3K), developing devices 4 (4Y, 4M, 4C, 4K), cleaning blades 6 (6Y, 6M, 6C, 6K), and the like.

The intermediate transfer unit 10 is supported by the main body of the apparatus, and includes a plurality of primary transfer rollers 5 (5Y, 5M, 5C, 5K) as transfer members, a secondary transfer roller 9, a secondary transfer counter roller 8, and a cleaning device 11. In addition, an intermediate transfer belt 7 (intermediate transfer member) which is an endless cylindrical belt is provided. The intermediate transfer belt 7 is installed on a belt frame (not illustrated) and is stretched by the secondary transfer counter roller 8, a first tension roller 17, a second tension roller 18, and a separating roller 19. That is, the intermediate transfer belt 7 is stretched by a plurality of stretching rollers.

Upon image formation, when a CPU 60 issues a print signal, a sheet S stacked and stored in a sheet stacking portion 12 by a feed roller 13 adopting a friction separation method is sent to a registration roller 14 via a conveyance path. After that, the sheet is fed to the image forming portion after skew feeding correction or timing correction are performed by the registration roller 14.

On the other hand, in the image forming portion, the surface of the photosensitive drum 1 is first charged by the charging roller 2. Then, a laser scanner unit 3 emits laser light from a light source (not illustrated) provided inside and irradiates the photosensitive drum 1 with the laser light according to image information. Therefore, an electrostatic latent image corresponding to the image information is formed on the surface of the photosensitive drum 1.

The electrostatic latent image is developed by adhering a toner by the developing device 4, thereby forming a toner image (developer image) on the photosensitive drum 1. In the present embodiment, a two-component developer including a non-magnetic toner and a magnetic carrier is used as a developer, but a one-component developer including only a magnetic toner or a non-magnetic toner may also be used.

After that, in primary transfer nip portions N (NY, NM, NC, NK) in which a primary transfer electric field is formed by applying a primary transfer bias to the primary transfer roller 5, the toner images formed on the photosensitive drums 1 are primarily transferred onto the intermediate transfer belts 7, respectively.

Figure 2:
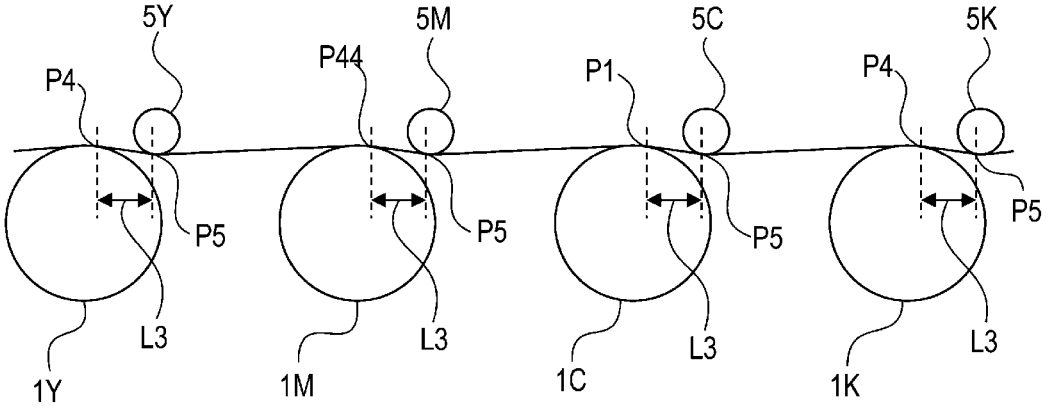
FIG. 2 is an explanatory diagram relating to the arrangement of a primary transfer roller.

Here, as illustrated in FIG. 2, each primary transfer roller 5 is disposed to be offset from each photosensitive drum 1 by a distance L3 on the downstream side in a moving direction of the intermediate transfer belt 7. In addition, in the moving direction of the intermediate transfer belt 7, a contact point P4 is a downstream side end portion of a region at which each photosensitive drum 1 and the intermediate transfer belt 7 abut, and is a position (first position) at which each photosensitive drum 1 and the intermediate transfer belt begin to be separated from each other. In addition, a contact point P5 is an upstream end portion of a region at which the intermediate transfer belt 7 and each primary transfer roller 5 abut, and a position (second position) at which the intermediate transfer belt 7 and each primary transfer roller 5 begin to abut.

In addition, in the present embodiment, the distance L3 is within the range of 3.5 mm to 7.0 mm. In addition, although the distances L3 are the same in the respective image forming portions, at least one of the distances L3 may be set to a different value. In addition, the primary transfer roller 5 is made of a conductor such as a metal or a conductive resin having a volume resistance of 600Ωcm or less.

Next, as illustrated in FIG. 1, the intermediate transfer belt 7 rotates in a direction of an arrow X when the secondary transfer counter roller 8 receives a driving force from a driving source and rotates in a direction of an arrow R1. The primarily transferred toner image reaches the secondary transfer portion formed by the secondary transfer counter roller 8 and the secondary transfer roller 9 positioned downstream in the rotation direction by the rotation of the intermediate transfer belt 7, and the toner image is transferred onto the sheet.

The sheet onto which the toner image is transferred is sent to the fixing device 15, heated, and pressed to fix the toner image on the sheet, and then discharged to a discharge tray 16.

The toner remaining on the photosensitive drum 1 after the primary transfer is removed by the cleaning blade 6. In addition, the toner remaining on the intermediate transfer belt 7 after the secondary transfer is removed by the cleaning device 11.

In addition, when the toner amount in the developing device 4 of each color decreases, the toners of the respective colors stored in toner storage containers 21 (21Y, 21M, 21C, 21K) are supplied to the developing devices 4 by toner replenishing devices 22 (22Y, 22M, 22C, 22K), respectively. Although not illustrated, the toner replenishing devices 22M, 22C, and 22K have the same shape as the toner replenishing device 22Y.

<Intermediate Transfer Unit>

Figure 3A:
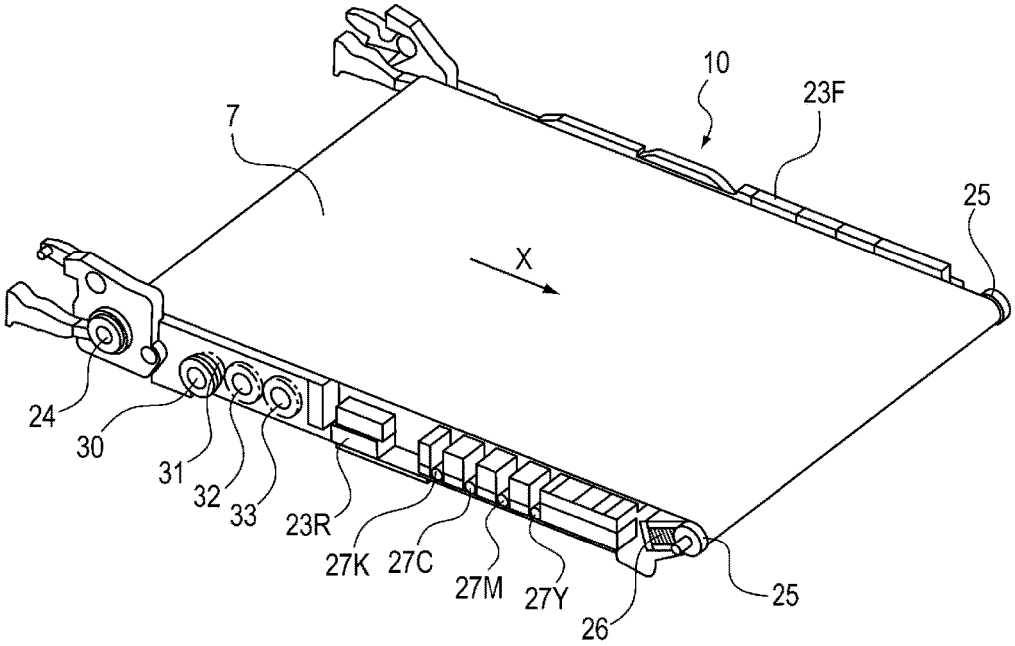
FIGS. 3A and 3B are perspective views of an intermediate transfer unit.
Figure 3B:
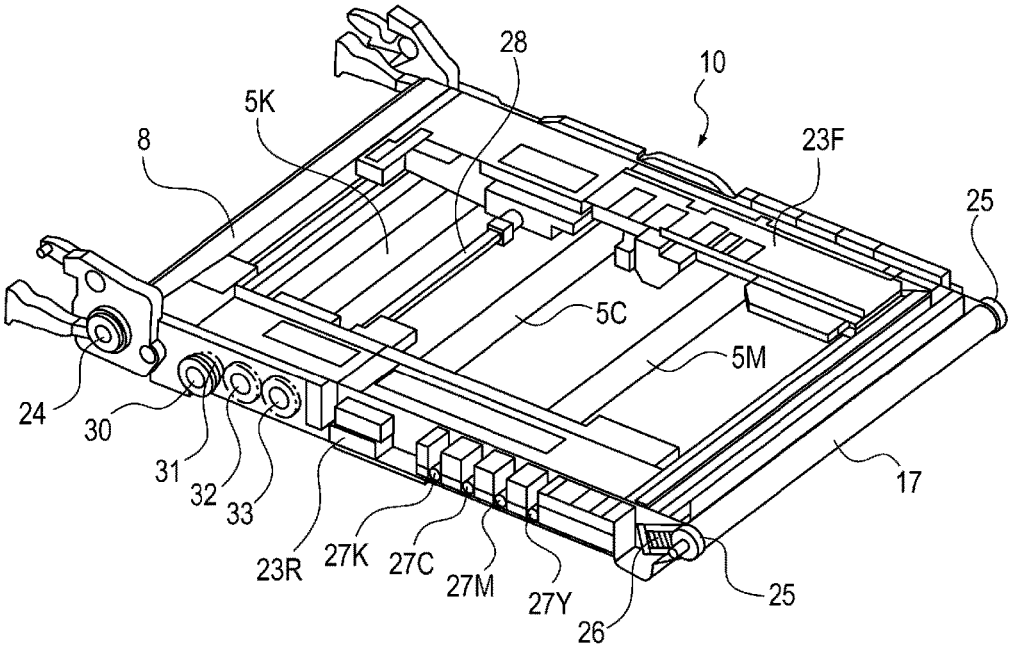

Next, the configuration of the intermediate transfer unit 10 will be described. FIGS. 3A and 3B are perspective views of the intermediate transfer unit 10. FIG. 3A illustrates a state in which the intermediate transfer belt 7 is installed and stretched, and FIG. 3B illustrates a state in which the intermediate transfer belt 7 is detached.

As illustrated in FIGS. 3A and 3B, the intermediate transfer unit 10 includes a front frame 23F and a rear frame 23R. The front frame 23F is disposed on the side illustrated in FIG. 1 in the rotational axis direction of the primary transfer roller 5, and the rear frame 23R is disposed on the opposite side thereof.

In addition, the front frame 23F and the rear frame 23R rotatably and axially support both end portions of the secondary transfer counter roller 8, the second tension roller 18, the separating roller 19, the separating shaft 28, and the like in the rotational axis direction in a sandwiched form.

In addition, a driving coupling 24 is attached to one end portion of the rotational shaft of the secondary transfer counter roller 8. The driving coupling 24 is connected to an output shaft of a belt driving unit (not illustrated) for driving the intermediate transfer belt 7, and a driving force is transmitted to the driving coupling 24. When the driving force is transmitted, the secondary transfer counter roller 8 having the surface with a relatively high friction coefficient such as a rubber rotates, thereby rotating the intermediate transfer belt 7 in a direction of an arrow X. In the present embodiment, the driving coupling 24 is used as a driving transmission unit, but may be connected by using a gear.

In addition, a gear 33 is provided at one end portion of the separating shaft 28 in an axial direction. In addition, a separating coupling 30 and gears 31 and 32 connected to an output shaft of a separating driving unit (not illustrated) are provided in the vicinity of the gear 33. Then, the driving force transmitted from the separating driving unit (not illustrated) to the separating coupling 30 is transmitted to the gear 33 via the gears 31 and 32, such that the separating shaft 28 rotates.

In addition, the front frame 23F and the rear frame 23R are provided with a pair of tension bearings 25. The tension bearings 25 rotatably and axially support both end portions of the first tension roller 17 in a rotational axis direction in a sandwiched form. In addition, in a state in which the intermediate transfer belt 7 illustrated in FIG. 3A is installed, a tension spring 26 (biasing member) which is a compression spring is provided between the front frame 23F and the rear frame 23R and the tension bearing 25 in a contracted state. Then, a tension force acting on the inner periphery of the intermediate transfer belt 7 is applied to the first tension roller 17 by the biasing force of the tension spring 26.

In addition, the intermediate transfer unit 10 has feeding portions 27 (27Y, 27M, 27C, 27K). The feeding portions 27 feed the primary transfer bias to the corresponding primary transfer rollers 5, respectively. A description of a main feeding configuration from a high-voltage board (not illustrated) provided in the image forming apparatus A to the feeding portion 27 will be omitted.

<Movement of Transfer Member>

Next, the movement of the primary transfer roller 5 as the transfer member will be described. When the monochrome mode and the color mode are switched, the primary transfer rollers 5Y, 5M, and 5C (first transfer member) other than black K move from an abutting position which abuts with the intermediate transfer belt 7 to a separating position which is separated from the intermediate transfer belt 7 by a separating slider 40.

Figure 4:
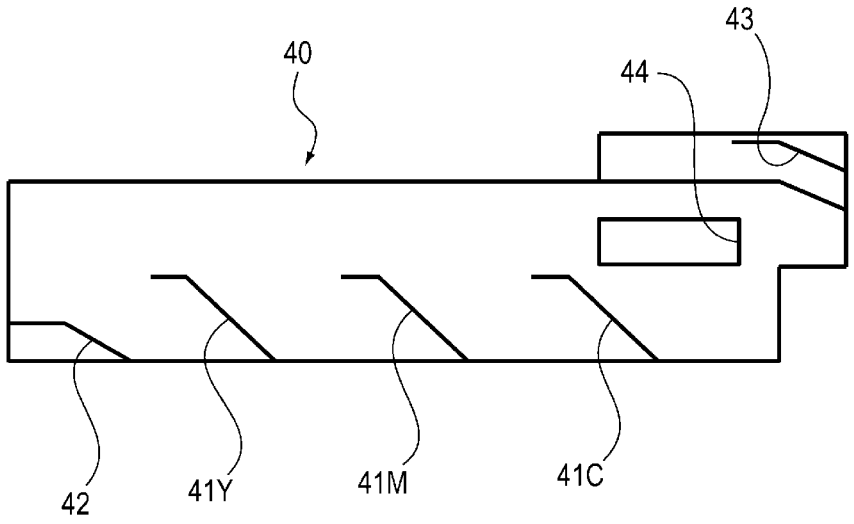
FIG. 4 is a schematic cross-sectional view of a separating slider.

FIG. 4 is a schematic cross-sectional view of the separating slider 40. As illustrated in FIG. 4, the separating slider 40 has elevating surfaces 41 (41Y, 41M, 41C) for lifting and lowering the primary transfer rollers 5 (5Y, 5M, 5C) other than the primary transfer roller 5K of black K. In addition, the separating slider 40 has an elevating surface 42 for lifting and lowering the separating roller 19, a spring seat elevating surface 43, and a slide biasing surface 44. The separating sliders 40 are provided in the front frame 23F and the rear frame 23R, respectively, and have a symmetrical shape in the rotational axis direction of the primary transfer roller 5.

Figure 5A:
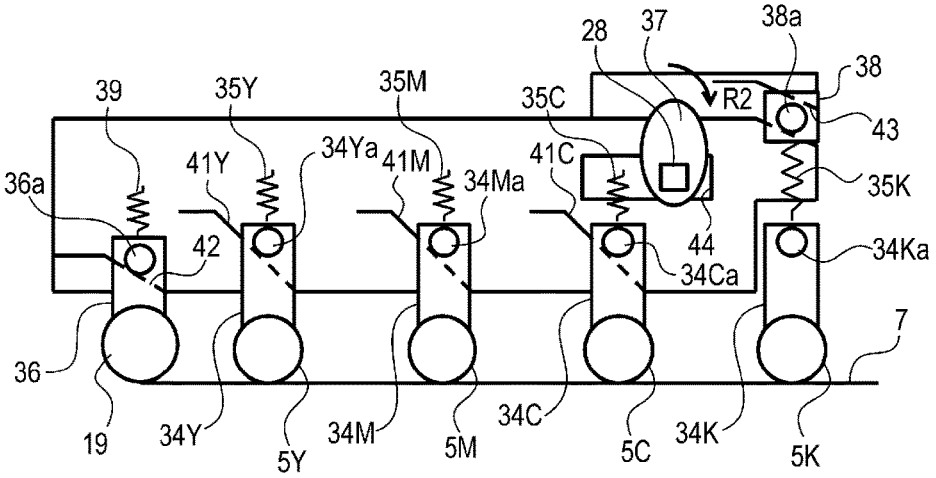
FIGS. 5A and 5B are cross-sectional views for explaining an operation in which a primary transfer roller and a separating roller move to a separating position.
Figure 5B:
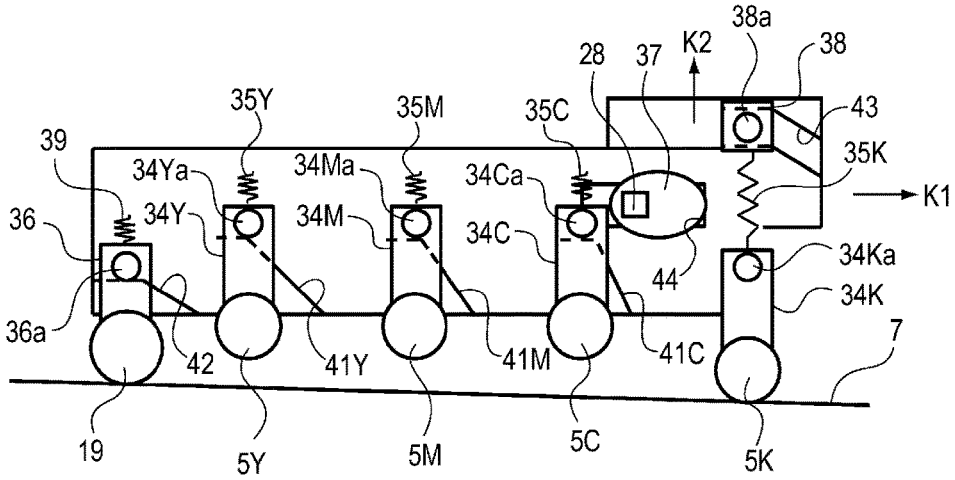

FIG. 5 is a cross-sectional view for explaining an operation in which the primary transfer roller 5 and the separating roller 19 move to a separating position. Here, FIG. 5A illustrates a state of the color mode and FIG. 5B illustrates a state of the monochrome mode.

As illustrated in FIG. 5, both end portions of each primary transfer roller 5 are rotatably and axially supported by a pair of primary transfer bearings 34 (34Y, 34M, 34C, 34K). In addition, while the movement of the intermediate transfer belt 7 in the moving direction is regulated by the front frame 23F and the rear frame 23R, the primary transfer bearing 34 is fitted and held to be elevatable vertically upwardly and downwardly. The primary transfer bearing 34 is biased together with the primary transfer roller 5 downward in the vertical direction by primary transfer springs 35 (35Y, 35M, 35C, 35K) as a spring member, and as a biasing unit. That is, each of the primary transfer rollers 5 is biased against the intermediate transfer belt 7 by the biasing force of the primary transfer spring 35.

In addition, both end portions of the separating roller 19 (stretching member) disposed at a position adjacent to the upstream side of the primary transfer roller 5Y at the most upstream position with respect to the moving direction of the intermediate transfer belt 7 and stretching the intermediate transfer belt 7 are rotatably and axially supported by the separating roller bearing 36. In addition, while the movement of the intermediate transfer belt 7 in the moving direction is regulated by the front frame 23F and the rear frame 23R, it is fitted and held to be elevatable vertically upwardly and downwardly. In addition, it is biased together with the separating roller 19 downwardly in the vertical direction by the separating roller spring 39.

In addition, separating cams 37 as cam members are provided at both end portions of the separating shaft 28.

Next, a separating operation when a part of the primary transfer roller 5 moves from the abutting position which abuts with the intermediate transfer belt 7 to the separating position which is separated from the intermediate transfer belt 7 will be described.

When switching from the color mode to the monochrome mode, the driving power is input to the separating coupling 30 from a separating driving unit (not illustrated) which has received a signal from the CPU 60. Therefore, the driving power is transmitted to the separating shaft 28, and the separating cam 37 is rotated by 90 degrees in a direction of an arrow R2 (a state changes from a state of FIG. 5A to a state of FIG. 5B).

When the separating cam 37 rotates in the direction of the arrow R2, the separating cam 37 biases the slide biasing surface 44 of the separating slider 40. Therefore, the separating slider 40 slides in a direction of an arrow K1.

When the separating slider 40 slides in the direction of the arrow K1, protrusions 34Ya, 34Ma, and 34Ca of the primary transfer bearings 34Y, 34M, and 34C are pushed up by the elevating surfaces 41Y, 41M, and 41C. Therefore, the primary transfer rollers 5 (5Y, 5M, 5C) other than the primary transfer roller 5K of black K move from the abutting position which abuts with the intermediate transfer belt 7 to the separating position which is separated from the intermediate transfer belt 7.

That is, in the present embodiment, the separating slider 40 and the separating cam 37 are moving mechanisms capable of moving the primary transfer rollers 5Y, 5M, and 5C to the abutting position and the separating position, and the movement thereof is controlled by the rotation of the separating cam 37. In addition, as the elevating surfaces 41Y, 41M, and 41C (guide portions) of the separating slider 40 guide the protrusions 34Ya, 34Ya, and 34Ma (guided portions), the primary transfer rollers 5Y, 5M, and 5C move.

In addition, as the separating slider 40 slides, the protrusion 36*a* of the separating roller bearing 36 is pushed up by the elevating surface 42, and the separating roller 19 moves in a direction away from the intermediate transfer belt 7 from a position (third position) before the movement. At this time, the moving amount of the separating roller 19 is set to be smaller than the moving amounts of the primary transfer rollers 5Y, 5M, and 5C. Therefore, a position (fourth position) of the separating roller 19 after the movement is a position closer to the intermediate transfer belt 7 than the positions of the primary transfer rollers 5Y, 5M, and 5C after the movement, and the intermediate transfer belt 7 is stretched along the separating roller 19 (the state of FIG. 5B).

Figure 6A:
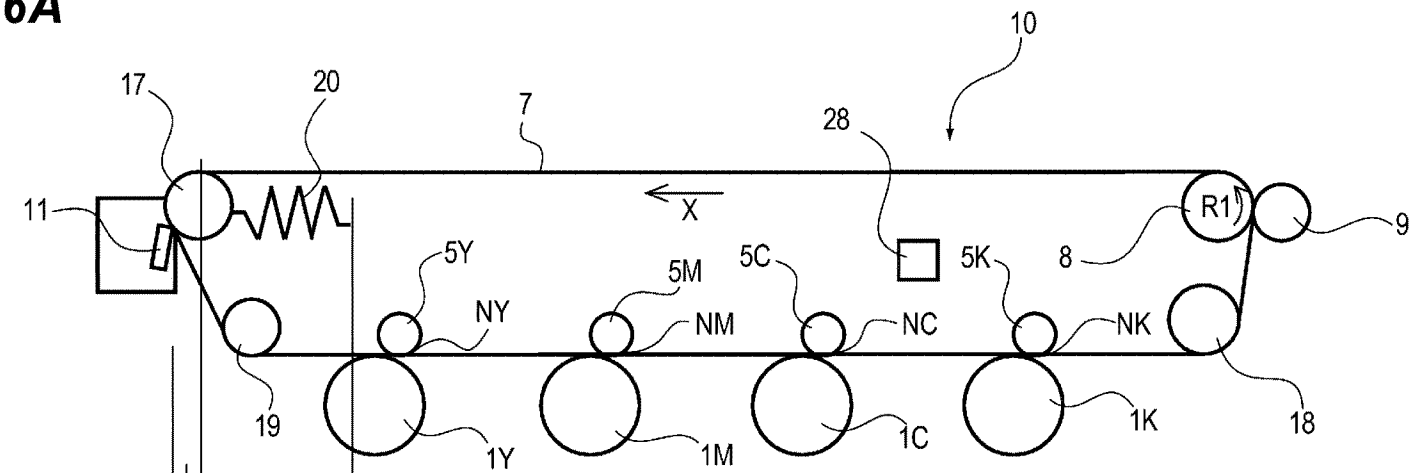
FIGS. 6A and 6B are cross-sectional views of an intermediate transfer unit in a monochrome mode and a color mode.
Figure 6B:
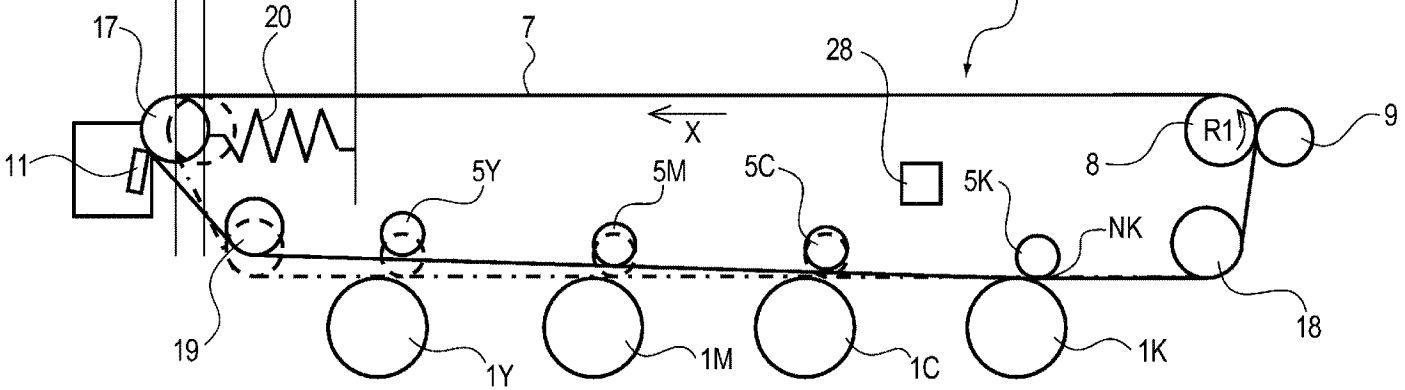

FIGS. 6A and 6B are cross-sectional views of the intermediate transfer unit 10 in the monochrome mode and the color mode. Here, FIG. 6A illustrates the state of the color mode and FIG. 6B illustrates the state of the monochrome mode.

The surplus length of the intermediate transfer belt 7, which is caused by the change in the stretching layout of the intermediate transfer belt 7 according to the mode change, is absorbed by the movement of the first tension roller 17 from the position indicated by a dashed line in FIG. 6B to a position indicated by a solid line. At this time, since the biasing force of the tension spring 20 against the intermediate transfer belt 7 decreases, the tension of the intermediate transfer belt 7 decreases, and the tension of the intermediate transfer belt 7 at the primary transfer nip portion NK also decreases.

Figure 7:
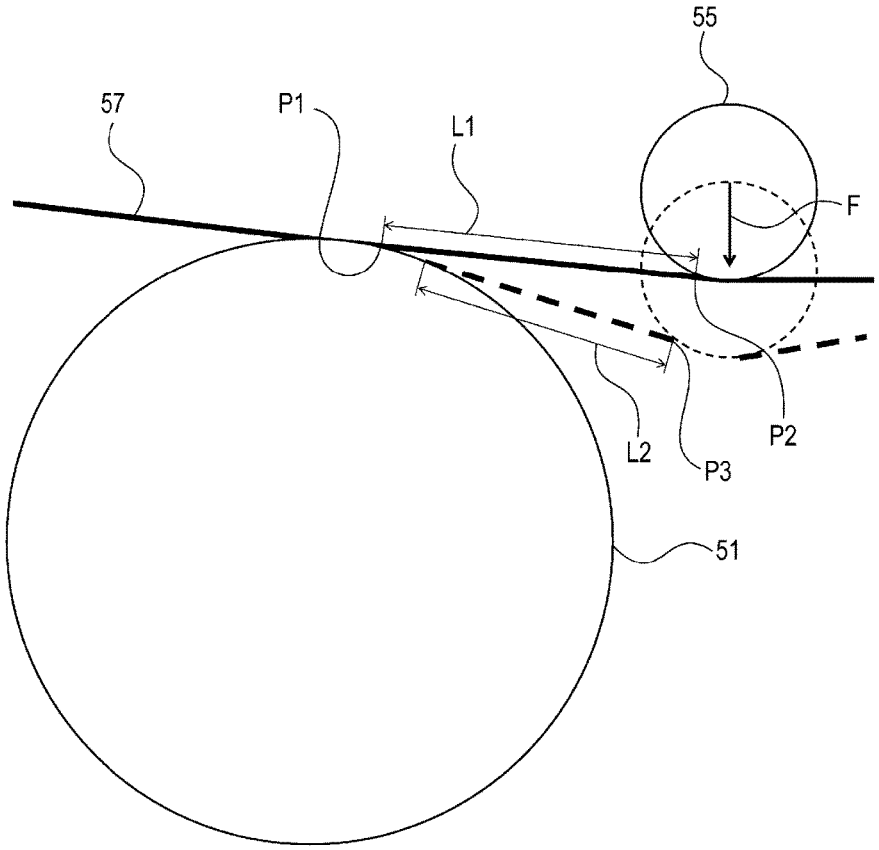
FIG. 7 is an explanatory diagram for explaining a problem of a conventional technique.

At this time, since the tension from the intermediate transfer belt 7 against the biasing force of the primary transfer spring 35K decreases, the position of the primary transfer roller 5K changes like the position change of the primary transfer roller 55 from the solid line to the dashed line illustrated in FIG. 7. Therefore, the distance L3 from the contact point P4 between the photosensitive drum 1K and the intermediate transfer belt 7 illustrated in FIG. 2 to the contact point P5 between the primary transfer roller 5K and the intermediate transfer belt 7 is reduced, and the primary transfer current may change and image defect may occur.

In the present embodiment, the biasing force of the primary transfer spring 35K is reduced by the following configuration to suppress the change in the position of the primary transfer roller 5K due to the change in the stretching layout. Therefore, the change in the primary transfer current is suppressed, and the occurrence of image defect is suppressed.

That is, as illustrated in FIGS. 5A and 5B, while the movement of the intermediate transfer belt 7 in the moving direction is regulated by the front frame 23F and the rear frame 23R, a variable spring seat 38 (first support portion) on which the primary transfer spring 35K is installed is fitted and held to be elevatable upwardly and downwardly in the vertical direction. In addition, the variable spring seat 38 is biased in the K2 direction which is upward in the vertical direction by the primary transfer spring 35K (elastic member).

Then, when switching from the color mode to the monochrome mode, the protrusion 38*a* of the variable spring seat 38 is pushed up by the spring seat elevating surface 43 of the separating slider 40 by the sliding of the separating slider 40 in the direction of the arrow K1 due to the rotation of the separating cam 37. That is, the variable spring seat 38 moves to a position away from the intermediate transfer belt 7 by interlocking with the movement of the primary transfer rollers 5Y, 5M, and 5C to the separating position separated from the intermediate transfer belt 7. In addition, the movement thereof is performed by guiding the protrusion 38*a* as the guided portion to the spring seat elevating surface 43 as the guide portion. That is, the separating slider 40 and the separating cam 37 form an interlocking mechanism for moving the variable spring seat 38 to a position away from the intermediate transfer belt 7 by interlocking with the movement of the primary transfer rollers 5Y, 5M, and 5C to the separating position separated from the intermediate transfer belt 7.

Due to this, the biasing force of the primary transfer spring 35K as the spring member when the primary transfer rollers 5Y, 5M, and 5C are at the separating position is smaller than that when the primary transfer rollers 5Y, 5M, and 5C are at the abutting position. Therefore, the biasing force of the primary transfer roller 5K (second transfer member) against the intermediate transfer belt 7 by the primary transfer spring 35K is reduced. At this time, the biasing force of the primary transfer spring 35K and the movement amount of the variable spring seat 38 are set such that the distance L3 from the contact point P4 to the contact point P5 illustrated in FIG. 2 during the image formation does not change in the monochrome mode and the color mode. At the time of the image formation, the biasing force of the primary transfer roller 5K against the intermediate transfer belt 7 changes according to the magnitude of the primary transfer bias, in addition to the stretching layout switching of the intermediate transfer belt 7, and thus the setting is also performed in consideration of this. That is, the primary transfer bearing 34K (second support portion), the primary transfer spring 35K, the variable spring seat 38, the separating slider 40, and the separating cam 37 form a changing mechanism for changing the biasing force for biasing the primary transfer roller 5K against the intermediate transfer belt 7. The changing mechanism also includes the interlocking mechanism.

With such a configuration, in the monochrome mode and the color mode, it is possible to suppress the change in the primary transfer current flowing from the primary transfer roller 5K to the photosensitive drum 1K, and it is possible to suppress the occurrence of image defect.

The switching from the monochrome mode to the color mode is performed by an operation opposite to the above separating operation when the separating cam 37 rotates by 90 degrees in the direction opposite to the direction of the arrow R2 illustrated in FIG. 5A.

In this embodiment, the compression spring is used as the biasing unit for biasing the primary transfer roller 5K, but the present invention is not limited thereto. That is, it may be any configuration as long as the biasing force for biasing the primary transfer roller 5 not separated against the intermediate transfer belt 7 is reduced in a state in which a portion of the plurality of primary transfer rollers 5 is separated from the intermediate transfer belt 7. Further, even when the primary transfer roller 5 is pressed against the intermediate transfer belt 7 with a configuration other than biasing the primary transfer roller 5, the effect of the present invention can be obtained.

In addition, although the configuration in which the primary transfer roller 5K of black K is not separated from the intermediate transfer belt 7 has been described in the present embodiment, the present invention is not limited thereto. That is, even when the primary transfer roller for transferring a developer of a color having a high use frequency to the intermediate transfer belt 7 is not separated, or even when the primary transfer rollers of a plurality of colors are not separated, the effect of the present invention can be obtained.

According to the present invention, it is possible to suppress the change in the primary transfer current in the configuration in which a part of the plurality of transfer members can be separated from the intermediate transfer belt.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

INDUSTRIAL APPLICABILITY

The present invention relates to an image forming apparatus and has industrial applicability.

The invention claimed is:

1. An intermediate transfer unit, which is supported by an image forming apparatus, the intermediate transfer unit comprising:

an endless intermediate transfer belt onto which developer images respectively formed on surfaces of first and second photosensitive members are transferred;

first and second transfer members which are respectively disposed corresponding to the first and second photosensitive members and abut on an inner peripheral surface of the intermediate transfer belt to transfer the developer images onto the intermediate transfer belt, wherein a first position which is a downstream side end portion of a region at which one of the photosensitive members and the intermediate transfer belt abut at the time of the transfer with respect to a moving direction of the intermediate transfer belt is disposed upstream of a second position which is an upstream side end portion of a region at which the intermediate transfer belt and one of the transfer members corresponding to the photosensitive member abut;

a moving mechanism which is capable of effecting movement between an abutting position at which the first transfer member abuts against the intermediate transfer belt and a separating position at which the first transfer member is separated from the intermediate transfer belt; and a changing mechanism which changes a biasing force for abutting the second transfer member against the intermediate transfer belt, wherein the biasing force is changed such that the biasing force when the first transfer member is at the separating position becomes weaker than the biasing force when the first transfer member is at the abutting position.

2. The intermediate transfer unit according to claim 1, wherein the changing mechanism changes the biasing force such that a distance between the first position and the second position along the intermediate transfer belt becomes equal both when the first transfer member is at the abutting position and when the first transfer member is at the separating position.

3. The intermediate transfer unit according to claim 1, wherein the changing mechanism comprises:

a first support portion whose position is changed;

a second support portion which supports the second transfer member; and an elastic member which is disposed between the first support portion and the second support portion and generates the biasing force, and wherein a position of the first support portion in the changing mechanism is moved so as be positioned farther away from the intermediate transfer belt when the first transfer member is at the separating position as compared to when the first transfer member is at the abutting position.

4. The intermediate transfer unit according to claim 3, wherein the changing mechanism has an interlocking mechanism which moves the first support portion by interlocking with the movement between the abutting position and the separating position of the first transfer member due to the moving mechanism.

5. The intermediate transfer unit according to claim 4, wherein the interlocking mechanism includes a cam member, and the first support portion is moved as the cam member is moved.

6. The intermediate transfer unit according to claim 1, wherein the first transfer member is provided in plurality, a stretching member which stretches the intermediate transfer belt from an inner peripheral surface side at a position adjacent to the upstream side of the first transfer member positioned at a most upstream position in the moving direction of the intermediate transfer belt is provided, and the stretching member moves from a third position to a fourth position at which the tension of the intermediate transfer belt is lower than at the third position, along with the movement of the first transfer member from the abutting position to the separating position.

7. The intermediate transfer unit according to claim 1, further comprising:

a tension roller which abuts against the inner peripheral surface of the intermediate transfer belt and applies a tension to the intermediate transfer belt;

a plurality of stretching rollers which stretch the intermediate transfer belt;

a frame which supports the plurality of stretching rollers;

a tension bearing which is movably supported with respect to the frame and rotatably and axially supports the tension roller; and a tension spring which is disposed between the tension bearing and the frame and applies a biasing force to the tension roller.

8. The intermediate transfer unit according to claim 1, wherein the second transfer member is a transfer member which transfers a black developer image onto the intermediate transfer belt.

9. An image forming apparatus comprising:

first and second photosensitive members;

an intermediate transfer unit, which is supported by the image forming apparatus, the intermediate transfer unit comprising:

an endless intermediate transfer belt onto which developer images respectively formed on surfaces of the first and second photosensitive members are transferred;

first and second transfer members which are respectively disposed corresponding to the first and second photosensitive members and abut on an inner peripheral surface of the intermediate transfer belt to transfer the developer images onto the intermediate transfer belt, wherein a first position which is a downstream side end portion of a region at which one of the photosensitive members and the intermediate transfer belt abut at the time of the transfer with respect to a moving direction of the intermediate transfer belt is disposed upstream of a second position which is an upstream side end portion of a region at which the intermediate transfer belt and one of the transfer members corresponding to the one photosensitive member abut;

a moving mechanism which is capable of effecting movement between an abutting position at which the first transfer member abuts against the intermediate transfer belt and a separating position at which the first transfer member is separated from the intermediate transfer belt; and a changing mechanism which changes a biasing force for abutting the second transfer member against the intermediate transfer belt, wherein the biasing force is changed such that the biasing force when the first transfer member is at the separating position becomes weaker than the biasing force when the first transfer member is at the abutting position.

* * * * *